US008662063B2

(12) United States Patent
Hu

(10) Patent No.: US 8,662,063 B2
(45) Date of Patent: Mar. 4, 2014

(54) ELECTRIC TOY GUN WITH AN ATTACHED CARTRIDGE CARRIER

(76) Inventor: Shih-Che Hu, Tainan (TW)

( * ) Notice: Subject to any disclaimer, the term of this patent is extended or adjusted under 35 U.S.C. 154(b) by 418 days.

(21) Appl. No.: 13/155,397

(22) Filed: Jun. 8, 2011

(65) Prior Publication Data

US 2012/0240911 A1 Sep. 27, 2012

(30) Foreign Application Priority Data

Mar. 21, 2011 (TW) ..... 100109571 A

(51) Int. Cl.

| | |
|---|---|
| ***F41A 9/61*** | (2006.01) |
| ***F41F 1/00*** | (2006.01) |
| ***F41B 7/08*** | (2006.01) |
| ***F41B 7/00*** | (2006.01) |

(52) U.S. Cl.

CPC . *F41A 9/61* (2013.01); *F41B 7/006* (2013.01); *F41F 1/00* (2013.01)

USPC ..... 124/41.1; 124/32; 124/45; 124/51.1; 124/66; 124/67; 124/80; 446/473

(58) Field of Classification Search

CPC ..... F14A 9/61; F41F 1/00; F41B 7/006

USPC ..... 124/32, 41.1, 45, 51.1, 66, 67, 80; 446/473

See application file for complete search history.

(56) References Cited

U.S. PATENT DOCUMENTS

| | | | | |
|---|---|---|---|---|
| 3,369,535 | A * | 2/1968 | Bonanno | 124/29 |
| 5,261,384 | A * | 11/1993 | Hu | 124/66 |
| 5,381,928 | A * | 1/1995 | Lee et al. | 222/79 |
| 5,522,374 | A * | 6/1996 | Clayton | 124/59 |
| 6,564,788 | B1 * | 5/2003 | Hu | 124/66 |
| 7,100,592 | B1 * | 9/2006 | Yang | 124/67 |
| 7,458,371 | B2 * | 12/2008 | Ong et al. | 124/65 |
| 7,694,448 | B2 * | 4/2010 | Iwasawa | 42/54 |
| 7,730,881 | B1 * | 6/2010 | Pedicini et al. | 124/65 |
| 7,841,329 | B2 * | 11/2010 | Yang | 124/66 |
| 7,878,184 | B2 * | 2/2011 | Klarborg | 124/65 |
| 7,946,283 | B2 * | 5/2011 | Lee et al. | 124/67 |
| 7,963,281 | B2 * | 6/2011 | Pong | 124/67 |
| 7,975,682 | B2 * | 7/2011 | Yang | 124/67 |
| 8,091,542 | B2 * | 1/2012 | Hu | 124/77 |
| 8,100,120 | B2 * | 1/2012 | Maeda | 124/77 |
| 8,146,577 | B2 * | 4/2012 | Hu | 124/32 |
| 8,297,269 | B2 * | 10/2012 | Hu | 124/67 |
| 8,302,589 | B2 * | 11/2012 | Lee et al. | 124/66 |
| 8,453,633 | B2 * | 6/2013 | Tsai | 124/66 |
| 2003/0098019 | A1 * | 5/2003 | Hu | 124/66 |
| 2006/0231083 | A1 * | 10/2006 | Tsurumoto | 124/66 |
| 2006/0243263 | A1 * | 11/2006 | Tsurumoto | 124/66 |

(Continued)

*Primary Examiner* — Gene Kim
*Assistant Examiner* — Alexander Niconovich
(74) *Attorney, Agent, or Firm* — Raymond Y. Chan; David and Raymond Patent Firm

(57) ABSTRACT

An electric toy gun includes a gun body carrying a piston set and a gear set having a first gearwheel provided with a side pin and rotatable to move the piston of the piston set, and an attached cartridge carrier, which includes a propelling member movable back and forth by the pin of the first gearwheel, a swivel hook member turnable back and forth by the propelling member, a cartridge rack hung on the swivel hook member and movable back and forth with the swivel hook member to simulate the cartridge feeding operation of a real gun and a return spring for returning the propelling member.

6 Claims, 8 Drawing Sheets

(56) References Cited

U.S. PATENT DOCUMENTS

| | | | | |
|---|---|---|---|---|
| 2006/0283431 | A1* | 12/2006 | Lee et al. | 124/41.1 |
| 2007/0006862 | A1* | 1/2007 | Zimmerman | 124/66 |
| 2007/0101982 | A1* | 5/2007 | Ong et al. | 124/65 |
| 2007/0261689 | A1* | 11/2007 | Tai et al. | 124/67 |
| 2007/0289586 | A1* | 12/2007 | Tsurumoto | 124/73 |
| 2008/0078369 | A1* | 4/2008 | Yeung | 124/67 |
| 2009/0217919 | A1* | 9/2009 | Pong Chun Chung | 124/80 |
| 2009/0235911 | A1* | 9/2009 | Klarborg | 124/66 |
| 2010/0065032 | A1* | 3/2010 | Yang | 124/27 |
| 2011/0214654 | A1* | 9/2011 | Lee et al. | 124/31 |
| 2011/0283984 | A1* | 11/2011 | Hu | 124/77 |
| 2012/0208430 | A1* | 8/2012 | Kung et al. | 446/473 |

* cited by examiner

ELECTRIC TOY GUN WITH AN ATTACHED CARTRIDGE CARRIER

BACKGROUND OF THE PRESENT INVENTION

1. Field of Invention

The present invention relates to electric toy guns and more particularly, to such an electric toy gun, which has an attached cartridge carrier that simulates the cartridge feeding operation of a real gun when the user triggers the electric toy gun.

2. Description of Related Arts

The driving principle of a conventional electric toy gun is performed in such a manner that a gearwheel set 10 is driven by an electric motor 100 to move the piston 301 of a piston set 30 toward the rear side in the gun body 20 by means of a first gearwheel 101 (see FIG. 1 in which the right side corresponds to the rear side of the electric toy gun). The piston 301 has a return spring 302 attached to the rear side thereof. The return spring 302 is adapted for returning the piston 301. When the first gearwheel 101 of the gearwheel set 10 reaches a predetermined position, the piston 301 is released from the constraint, and the return spring 302 immediately moves the piston 301 forwards to its former position, allowing release of a compressed spring power to drive a toy bullet (air-soft bullet) out of the gun barrel. Thus, one firing action is done, and the toy gun is reset for a next firing action.

In a conventional big scale electric toy gun, the aforesaid component parts are accommodated inside the gun body. The feeding of the toy bullets (air-soft bullets) is unlike the feeding of a belt of cartridges of a real gun, i.e., a conventional electric toy gun of this design cannot simulate the cartridge feeding operation of a real gun. Thus, conventional electric toy guns cannot enhance the player's game interest.

Therefore, it is desirable to provide an electric toy gun, which can simulate the cartridge feeding operation of a real gun during firing.

SUMMARY OF THE PRESENT INVENTION

The present invention has been accomplished under the circumstances in view. It is one object of the present invention to provide an electric toy gun, which is equipped with an attached cartridge carrier that simulates the cartridge feeding operation of a real gun when the user triggers the electric toy gun.

To achieve this and other objects of the present invention, an electric toy gun comprises a piston set and a gear set mounted in the gun body thereof, and an attached cartridge carrier. The gear set comprises a first gearwheel rotatable by an electric drive, for example, electric motor. The first gearwheel comprises a gear sector meshed with the piston set and rotatable to move the piston of the piston set, and a pin perpendicularly extended from one side thereof near the border. The attached cartridge carrier comprises a propelling member movable back and forth by the pin of the first gearwheel during rotation of the first gearwheel, a swivel hook member, which comprises a first end portion coupled to the propelling member and turnable back and forth by the propelling member during rotation of the first gearwheel, a second end portion and a pivot portion pivotally coupled to the gun body, a cartridge rack hung on the second end portion of the swivel hook member and movable back and forth with the swivel hook member during rotation of the first gearwheel, and a return spring for returning the propelling member after the propelling member having been moved.

Further, the propelling member comprises a driven butt extended from one end thereof movable by the pin of the first gearwheel.

Further, the driven butt has a beveled edge for abutment against the pin of the first gearwheel.

Further, the cartridge rack comprises a rack hung on the second end portion of the swivel hook member, and a belt of mimic cartridges carried on the rack and suspending outside the gun body.

Further, the second end portion of the swivel hook member extends out of the gun body. Further, the gun body is covered with a cover member that extends over the attached cartridge carrier.

Further, the propelling member comprises a retaining notch located on an opposite end thereof and coupled to the first end portion of the swivel hook member.

DETAILED DESCRIPTION OF THE PREFERRED EMBODIMENT

Figure 1:
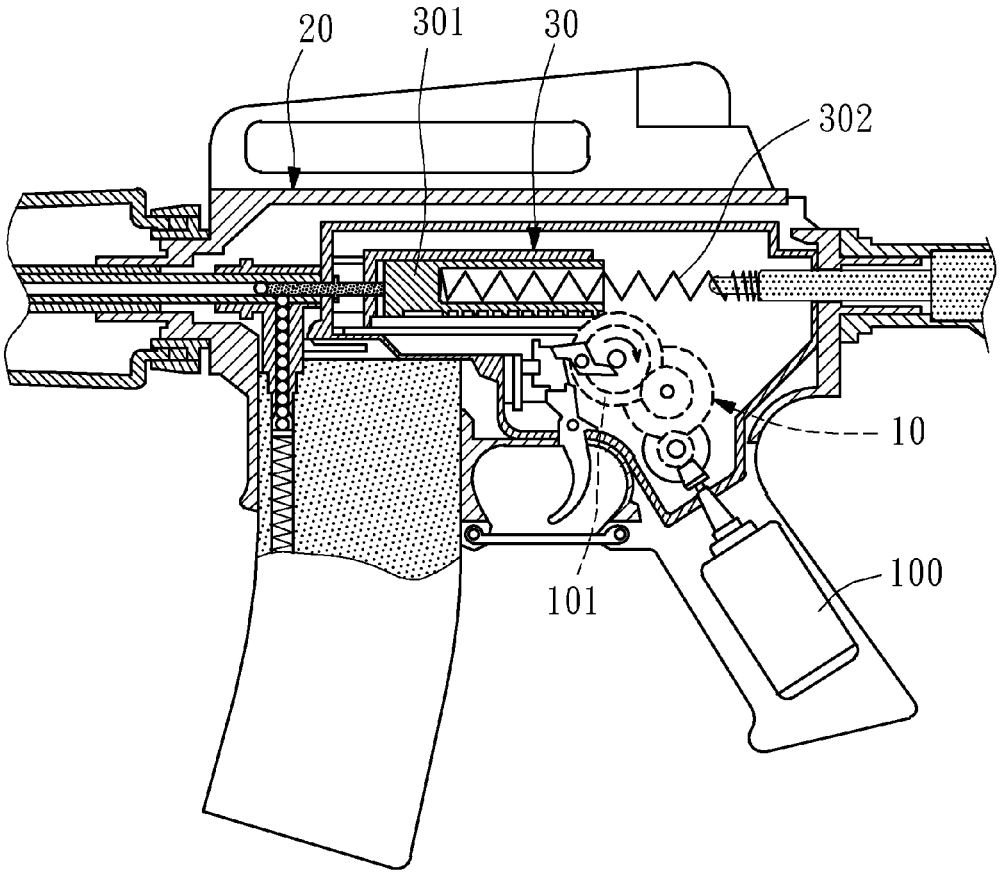
FIG. 1(PRIOR ART)
FIG. 1 is a schematic sectional side view illustrating the firing mechanism of an electric toy gun according to the prior art.
Figure 2:
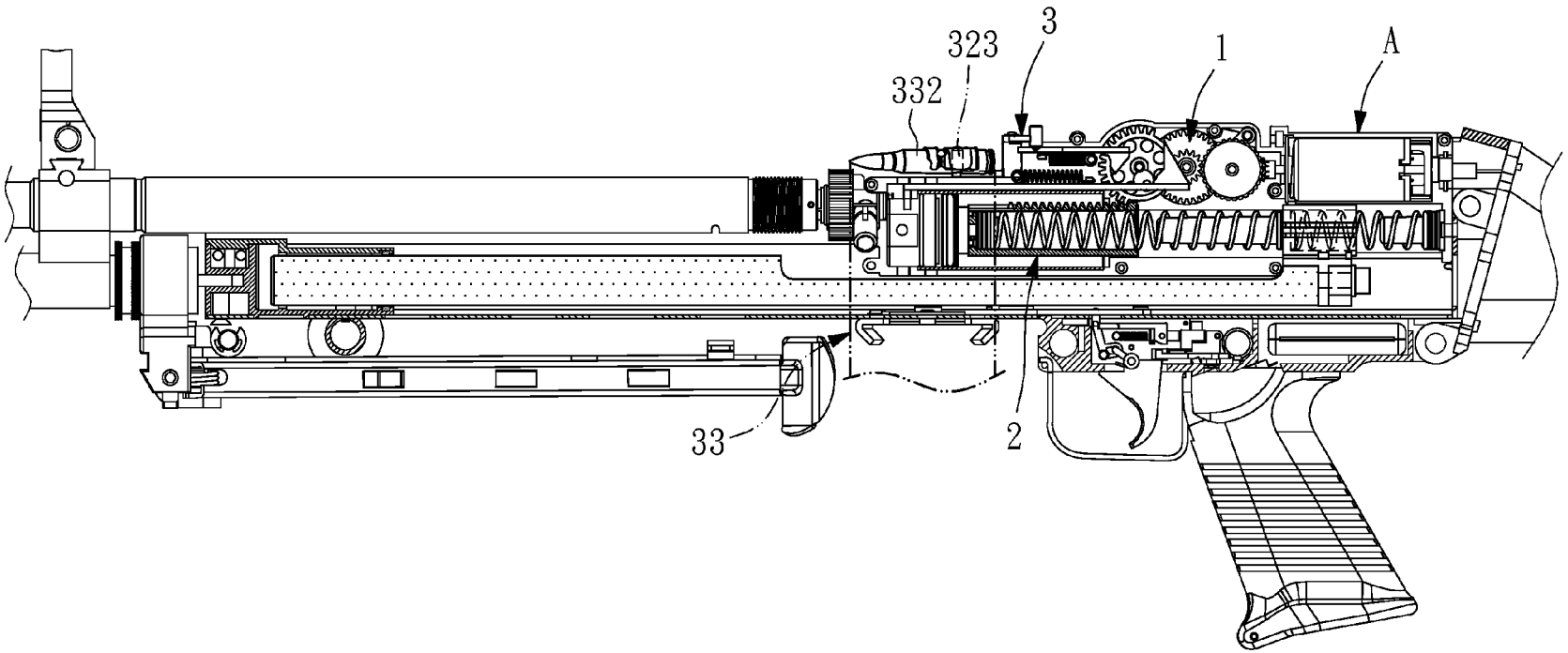
FIG. 2 is a plain view of an electric toy gun in accordance with the present invention.

Referring to FIG. 2, a gun body A of an electric toy gun in accordance with the present invention is shown comprising a gear set 1, a piston set 2, and an attached cartridge carrier 3.

Figure 3:
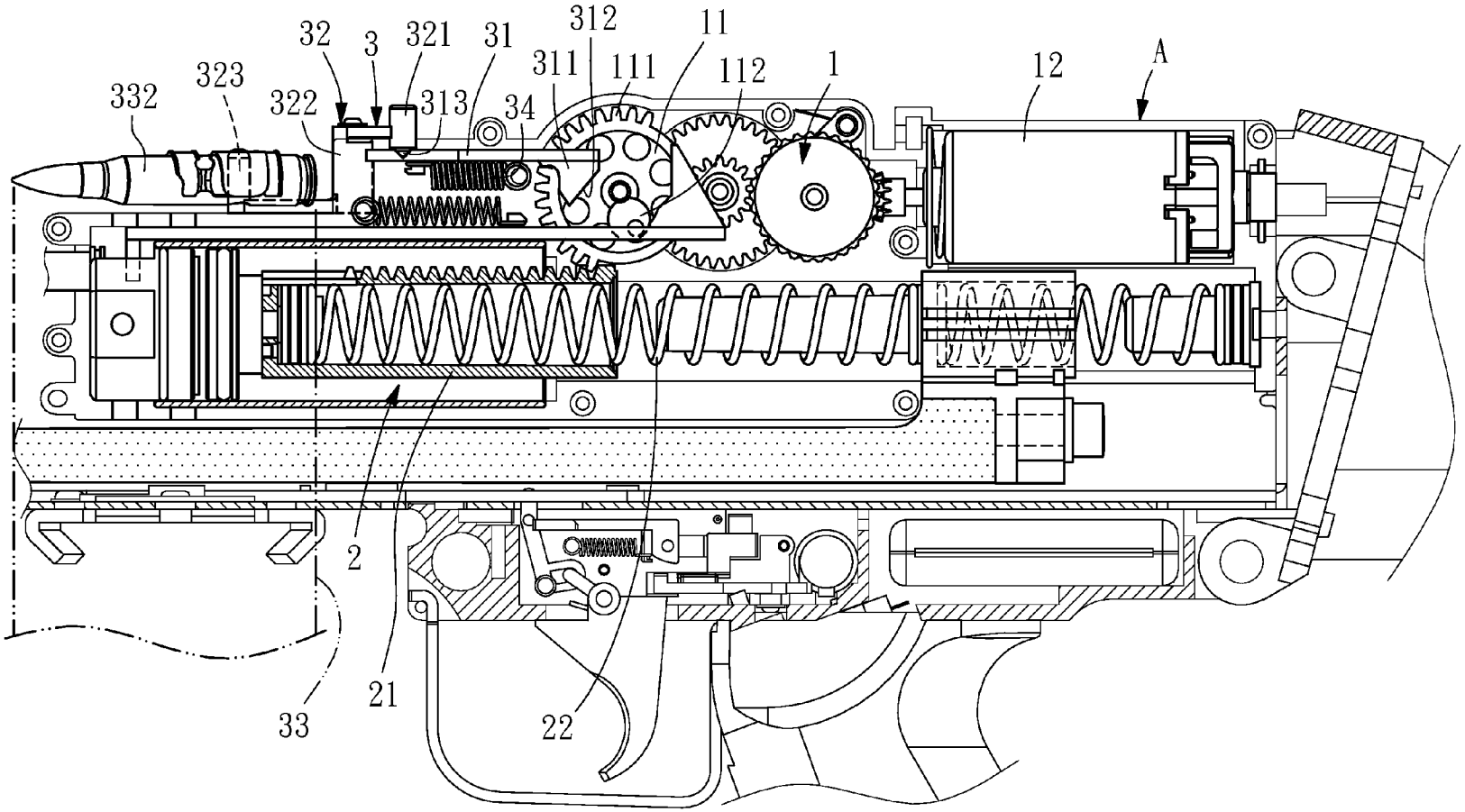
FIG. 3 is a plain view in an enlarged scale of the gun body of the electric toy gun in accordance with the present invention.

The gear set 1 comprises a first gearwheel 11 (see FIG. 3) rotatable by an electric drive 12 (for example, electric motor). The first gearwheel 11 comprises a gear sector 111 disposed above and meshed with the piston set 2 and rotatable to move a piston 21 of the piston set 2, and a pin 112 perpendicularly extended from one side thereof near the periphery.

Figure 4:
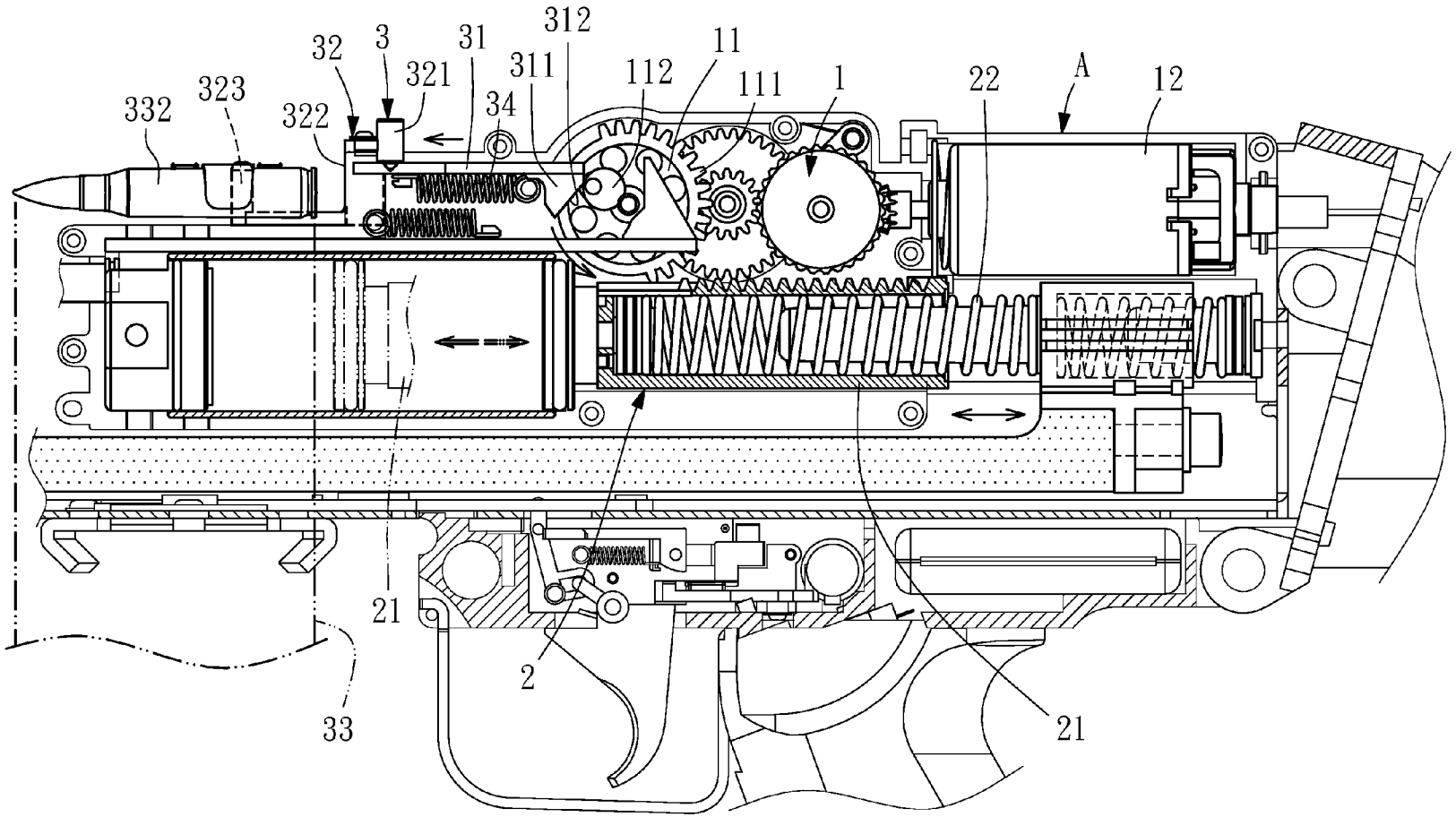
FIG. 4 corresponds to FIG. 3, illustrating the piston set moved during rotation of the gear set.

The piston set 2 comprises the aforesaid piston 21 (see FIG. 3), and a piston spring 22 attached to the piston 21. The piston spring 22 is compressed when the piston 21 is moved backwards by the gear sector 111 of the first gearwheel 11. When the first gearwheel 11 is rotated to a predetermined position, the gear sector 111 is disengaged from the piston 21, and the piston spring 22 is released from the constraint to push the piston 21 back to its former position (see FIG. 4).

Figure 5:
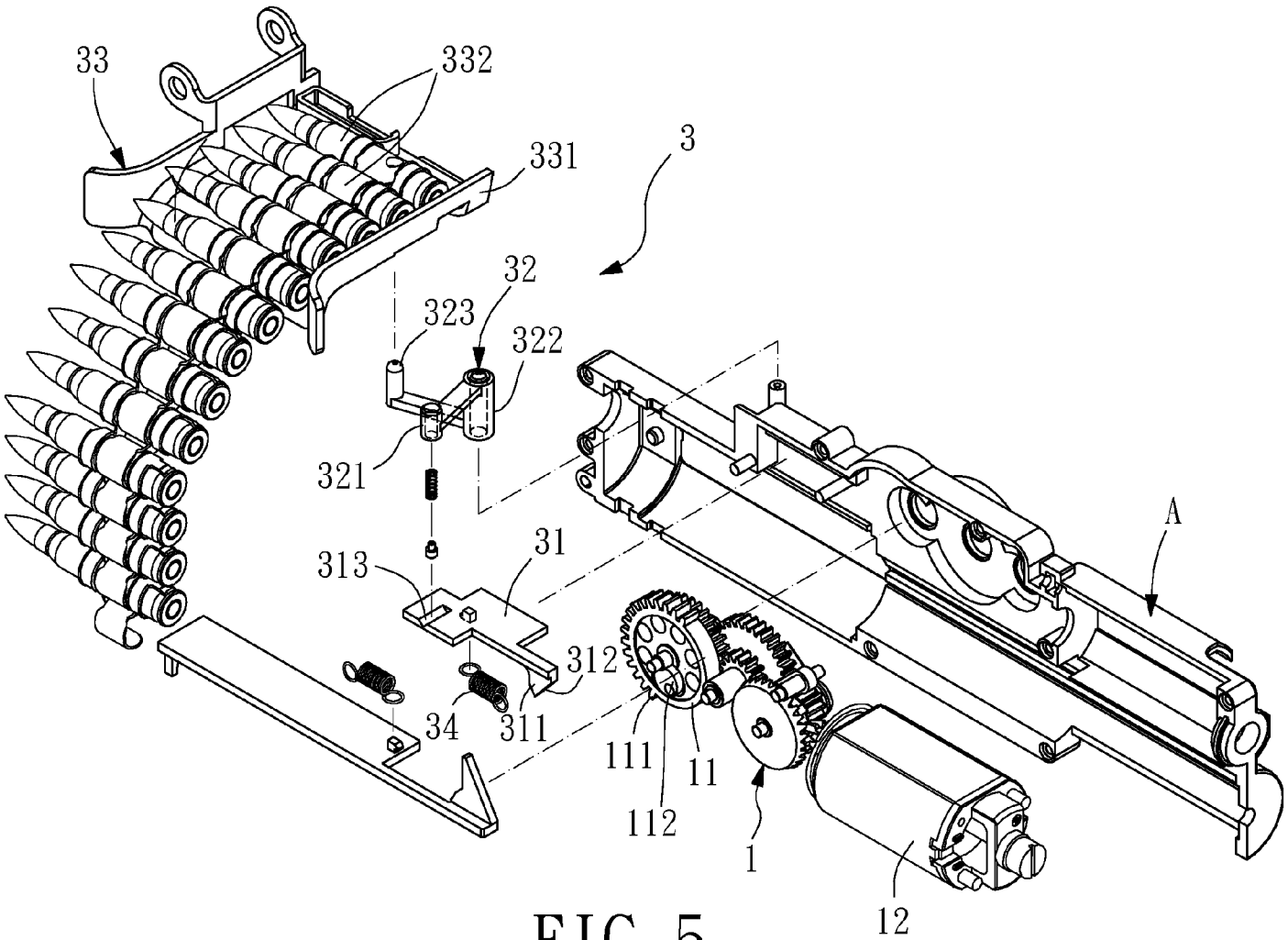
FIG. 5 is an exploded view of a part of the gun body of the electric toy gun in accordance with the preset invention, illustrating the structure of the gear set and the attached cartridge carrier.
Figure 6:
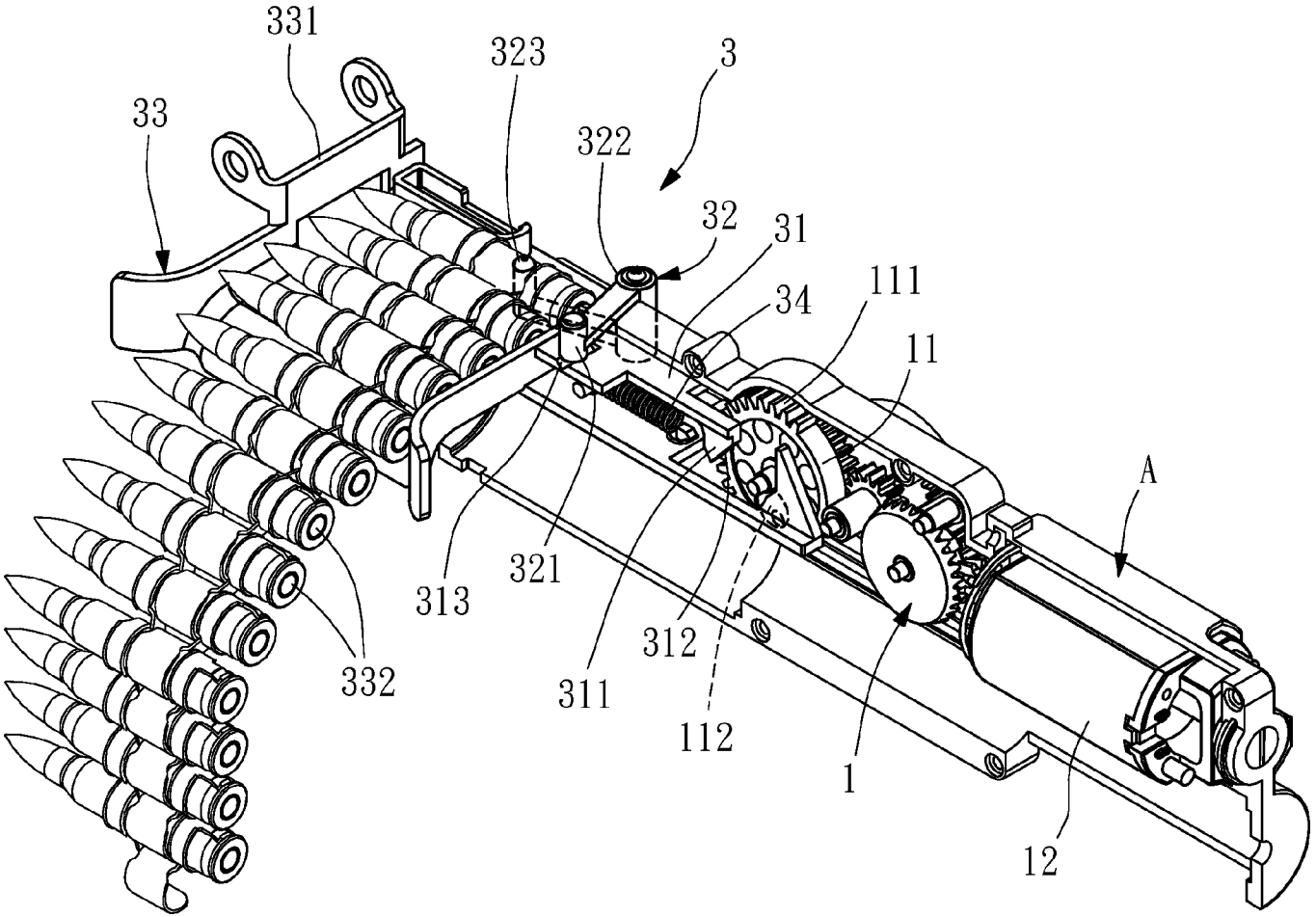
FIG. 6 is an assembly view of FIG. 5.
Figure 7:
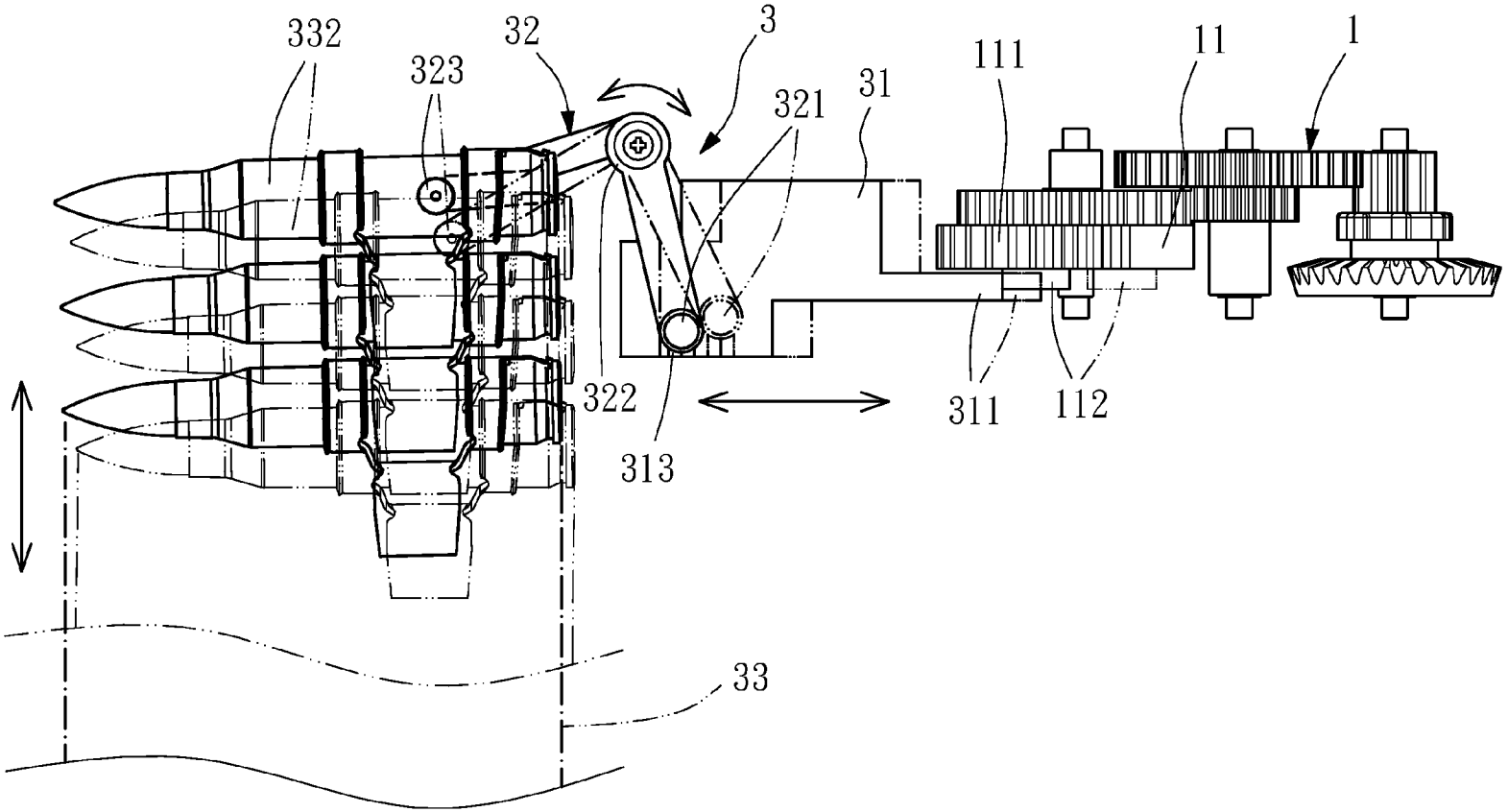
FIG. 7 is a schematic drawing illustrating the attached cartridge carrier moved back and forth during rotation of the gear set.
Figure 8:
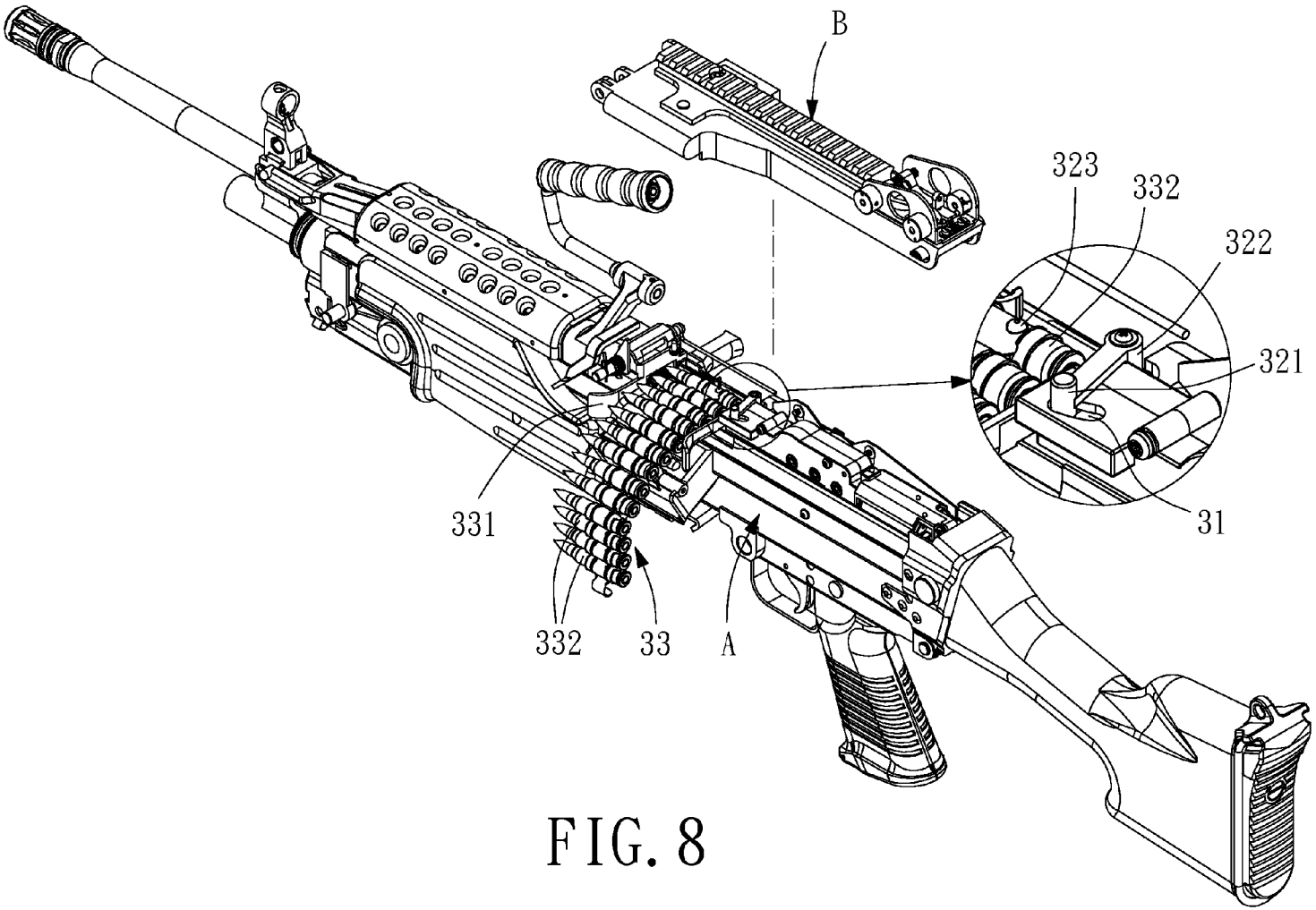
FIG. 8 is a perspective view, partially exploded and partially enlarged, of the electric toy gun in accordance with the present invention.

The attached cartridge carrier 3 (see FIGS. 5 and 6) comprises a propelling member 31, a swivel hook member 32, a cartridge rack 33 and a return spring 34. The return spring 34 is coupled to the propelling member 31, and adapted for returning the propelling member 31 after the propelling member 31 having been moved. The propelling member 31 comprises a driven butt 311 extended from one end thereof. The driven butt 311 has a beveled edge 312. During rotation of the first gearwheel 11, the pin 112 will be moved to stop against the beveled edge 312 of the driven butt 311, thereby biasing the propelling member 31 (see FIG. 4). After the pin 112 is moved over the beveled edge 312 of the driven butt 311, the return spring 34 immediately returns the propelling member 31 (see FIG. 3). The propelling member 31 further comprises a retaining notch 313 located on an opposite end thereof. The swivel hook member 32 comprises a first end portion 321, a second end portion 323, and a pivot portion 322 connected between the first end portion 321 and the second end portion 323. The first end portion 321 is coupled to the retaining notch 313 of the propelling member 31. The pivot portion 322 is pivotally connected to the gun body A. The propelling member 31 is alternatively moved back and forth by the pin 112 of the first gearwheel 11 (see FIGS. 3 and 4), causing the first end portion 321 of the swivel hook member 32 to be turned back and forth by the propelling member 31, and therefore the pivot portion 322 is rotated relative to the gun body A to turn the second end portion 323 back and forth (see FIG. 7). Further, the second end portion 323 protrudes over the outside wall of the gun body A of the electric toy gun. Further, a cover member B is covered on the top side of the gun body A over the attached cartridge carrier 3 (see FIG. 8). The cartridge rack 33 comprises a rack 331 carrying a belt of mimic cartridges 332 (see FIG. 5). The rack 331 is hung on the second end portion 323 of the swivel hook member 32 so that the belt of mimic cartridges 332 suspends outside the gun body A.

During application, the cartridge rack 33 is hung on the second end portion 323 of the swivel hook member 32 (see FIG. 2). Thus, when the user presses the trigger of the electric toy gun and keeps the trigger in the pressed position, the first gearwheel 11 is continuously rotated, and the pin 112 is moved with the first gearwheel 11 to push the propelling member 31 repeatedly at a predetermined time interval (see FIGS. 3 and 4), causing the swivel hook member 32 to be turned back and forth by the propelling member 31 (see FIG. 7), and therefore the cartridge rack 33 is alternatively moved back and forth, simulating the cartridge feeding operation of a real gun.

As stated above, subject to the attached arrangement of the attached cartridge carrier 3 and the design of the pin 112 of the first gearwheel 11 for driving the propelling member 31 to turn the swivel hook member 32 back and forth, the cartridge rack 33 can be alternatively moved back and forth to simulate the cartridge feeding operation of a real gun, enhancing the player's game interest and increasing the value of the product.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric toy gun comprising: a piston set and a gear set mounted in a gun body thereof, said gear set comprising a first gearwheel rotatable by an electric drive, said first gearwheel comprising a gear sector meshed with said piston set and rotatable to move a piston of said piston set and a pin perpendicularly extended from one side thereof near the border, and an attached cartridge carrier, wherein said attached cartridge carrier comprises:

a propelling member movable back and forth by the pin of said first gearwheel during rotation of said first gearwheel;

a swivel hook member, said swivel hook member comprising a first end portion coupled to said propelling member and turnable back and forth by said propelling member during rotation of said first gearwheel, a second end portion, and a pivot portion pivotally coupled to said gun body;

a cartridge rack hung on said second end portion of said swivel hook member and movable back and forth with said swivel hook member during rotation of said first gearwheel; and a return spring for returning said propelling member after said propelling member having been moved.

2. The electric toy gun as claimed in claim 1, wherein said propelling member comprises a driven butt extended from one end thereof and movable by said pin of said first gearwheel.

3. The electric toy gun as claimed in claim 2, wherein said driven butt has a beveled edge for abutment against said pin of said first gearwheel.

4. The electric toy gun as claimed in claim 2, wherein said cartridge rack comprises a rack hung on said second end portion of said swivel hook member and a belt of mimic cartridges carried on said rack and suspending outside said gun body.

5. The electric toy gun as claimed in claim 4, wherein said second end portion of said swivel hook member extends out of said gun body, and a cover member covered on the top side of said gun body over said cartridge carrier.

6. The electric toy gun as claimed in claim 5, wherein said propelling member further comprises a retaining notch located on an opposite end thereof and coupled to said first end portion of said swivel hook member.

* * * * *